United States Patent [19]

Storey

[11] 4,023,031

[45] May 10, 1977

[54] LUMINAIRE

[75] Inventor: Stanley Herbert Storey, Norwich, England

[73] Assignee: Berkey Photo, Inc., New York, N.Y.

[22] Filed: Oct. 7, 1975

[21] Appl. No.: 620,343

[30] Foreign Application Priority Data

July 24, 1975 United Kingdom ..... 30962/75

[52] U.S. Cl. ..... 240/37; 240/3; 240/44

[51] Int. Cl.[2] ..... F21V 19/04

[58] Field of Search ..... 240/37, 11, 44, 44.1, 240/44.2, 3

[56] References Cited

UNITED STATES PATENTS 3,267,274 8/1966 Johnson ..... 240/44 X

*Primary Examiner*—John Gonzales

*Attorney, Agent, or Firm*—Wigman & Cohen

[57] ABSTRACT

A luminaire consisting of a Fresnel spot light combined with a studio flood-light arranged back-to-back so that when the spot-light is in use and the flood-light is inactive, displacement of the lamp carriage of the spot-light can be accommodated by passing it through an opening in the main reflector of the inactive flood-light, or by displacing the main reflector of the flood-light, thus saving space.

8 Claims, 5 Drawing Figures

LUMINAIRE

The invention relates to luminaires.

BACKGROUND OF THE INVENTION

Both Fresnel spot-light and flood-lights are known for particular purposes in the theatre, and are sometimes required to be used in succession. However, as they are fairly bulky, when space is restricted this may be difficult.

An object of the invention is to provide a luminaire which can be used in a restricted space but provides the functions of both a Fresnel spotlight and a flood-light.

According to the invention there is provided a luminaire including a Fresnel spot-light part united with a studio flood-light part, wherein, when the spot-light part is in use and the flood-light part inactive, at least some of the displacement of the lamp or lamp carriage and reflector of the Fresnel spot-light can be accommodated by passing through or displacing the main reflector of the inactive flood-light.

The invention will be further described, by way of example only, with reference to the accompanying drawings, which illustrate luminaires constituting embodiments of the invention.

In the drawings, which are schematic sectional side elevations:

Figure 1:
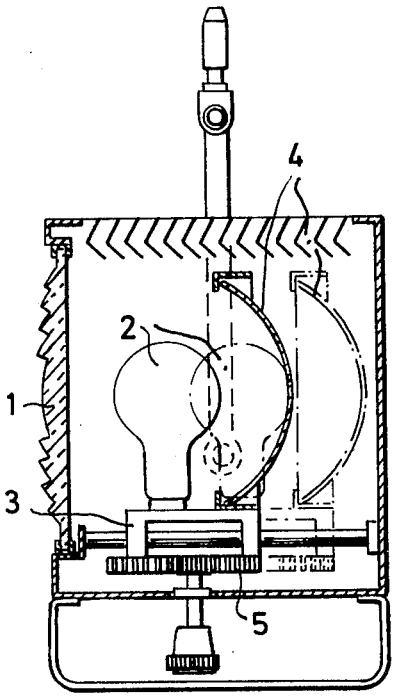
FIG. 1 shows a Fresnel spot-light.

In FIG. 1, 1 is the lens of the Fresnel spotlight, 2 is its lamp, 3 is the lamp carriage, 4 is its reflector and 5 is the focus rack.

A rearwardly displaced position of the carriage 3, lamp 2 and reflector 4 is shown in dotted lines.

Figure 2:
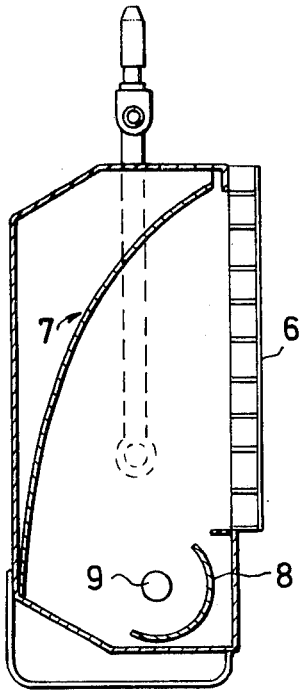
FIG. 2 shows a studio flood-light.

In FIG. 2, 6 is a removable diffuser screen of the flood-light part, 7 the main reflector, 8 the primary reflector, and 9 a linear lamp or lamps.

Figure 4:
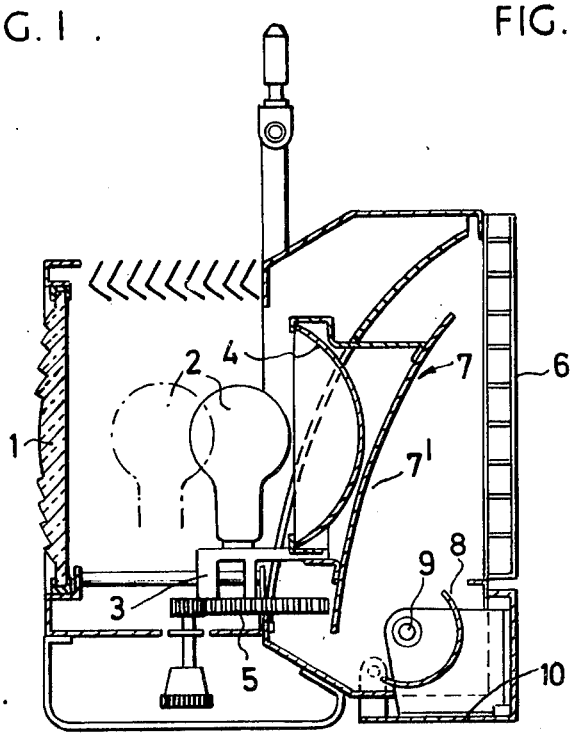
FIG. 4 shows the luminaire of FIG. 3 with the spot-light lamp carriage passing through the main reflector of the flood-light part.
Figure 3:
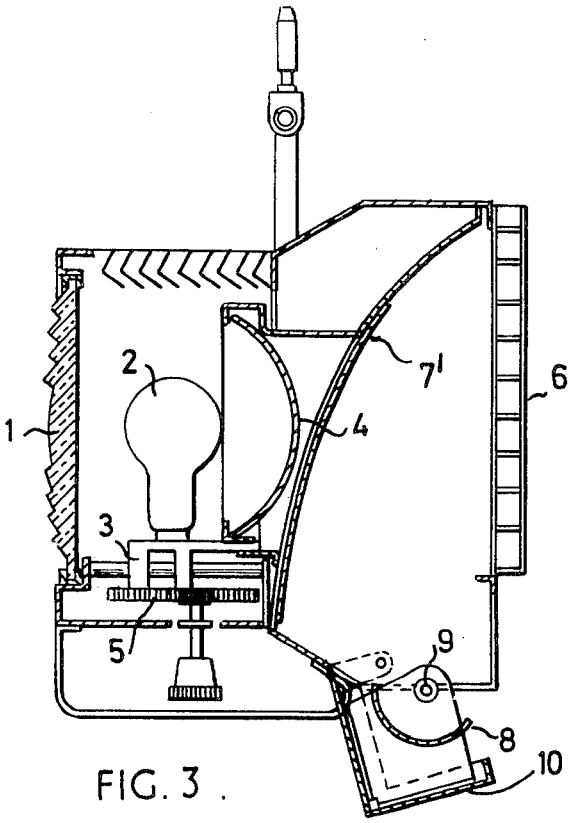
FIG. 3 shows a luminaire constituting a first embodiment of the invention.
Figure 5:
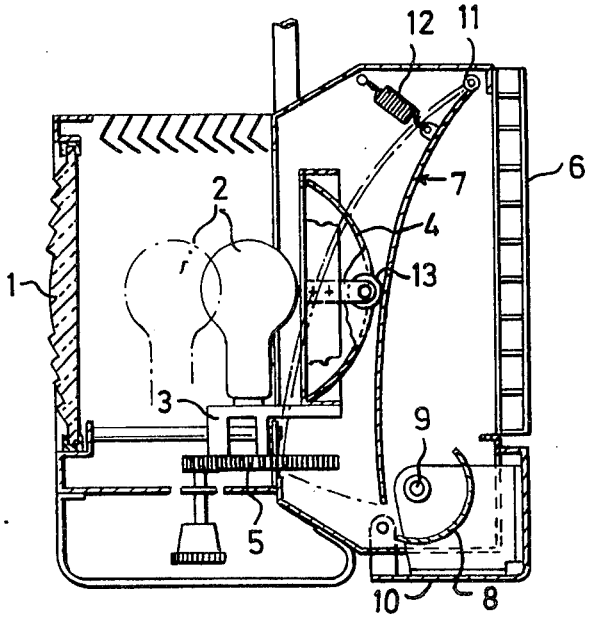
FIG. 5 shows a luminaire constituting a second embodiment of the invention, with the main reflector of the flood-light part displaced.

Similar parts are indicated in FIGS. 3, 4 and 5 by the same numerals.

In FIG. 3, the lamp-tray 10 carrying the primary reflector 8 and linear lamp 9 is hinged open. This allows servicing the primary reflector and changing lamps without having first to remove the diffuser screen 6. The lamp 2 of the Fresnel spot-light 3 is displaced fully forwards, allowing the flood-light part of the luminaire to be used.

FIG. 4 shows the luminaire of FIG. 3 in use as a Fresnel spot-lamp, in the full spot-focus position, the flood-light part being inactive. The lamp 2 is displaced to its maximum extent rearwards. This is achieved by making a portion 7′ of the main reflector 7 movable in unison with the reflector 4.

In the second embodiment, shown in FIG. 5, the main reflector 7 is hinged at 11, spring biased by a tension spring 12, and is displaced by a roller or rollers 13 fixed to the moving lamp carriage 3. The reflector 7 is in its operative position for use as a flood-light when the Fresnel spot-light carriage 3 is displaced fully forwards.

Although only preferred embodiments of the invention have been specifically illustrated and described herein, it is to be understood that minor modifications could be made therein without departing from the spirit of the invention as defined in the appended claims.

I claim:

1. A luminaire comprising in combination a Fresnel spot-light assembly and a flood-light assembly, said luminaire including a housing having a Fresnel lens at one end and a floodlight diffuser at the other end, said Fresnel assembly including a carriage, a reflector mounted on said carriage and movable along a focusing path toward and away from said Fresnel lens for focusing the Fresnel spot-light and a lamp mounted on said carriage between said lens and reflector, said flood-light assembly including a main reflector normally mounted in operative position relative to said flood light diffuser and a flood-light lamp mounted between said main reflector and said flood-light diffuser, said focusing path extending through the operative position of said main reflector, and wherein said main reflector is at least in part movable to accommodate the movement of said Fresnel carriage and reflector along said focusing path.

2. A luminaire as defined in claim 1, said main reflector including a first fixed portion and a second movable portion together defining a generally concave reflecting surface, and wherein said movable portion is displaceable relative to said fixed portion so as to provide an opening in said surface to permit said Fresnel carriage and reflector to move therethrough.

3. A luminaire as defined in claim 2, wherein said movable portion is displaceable toward said flood-light diffuser.

4. A luminaire as defined in claim 1, wherein said main reflector is swingably mounted in said housing from a first position where it impedes the movement of said Fresnel carriage and reflector along said focusing path to a second position displaced from said path.

5. A luminaire as defined in claim 4, said Fresnel reflector further including means for displacing said main reflector.

6. A luminaire as defined in claim 5, said main reflector being spring biased towards said first position, and wherein said displacing means is at least one roller carried by said Fresnel reflector adapted to bear against and effect swinging movement of said main reflector against said spring bias during focusing movement of said Fresnel assembly.

7. A luminaire as defined in claim 1, said floodlight assembly including a lamp tray having said flood-light lamp mounted therein, and wherein said lamp tray forms part of said housing and is movable from a closed position to an open position whereby said flood-light lamp may be changed without moving said diffuser.

8. A luminaire as defined in claim 7, wherein said lamp tray is pivotably mounted in said housing and is swingable downwardly beneath said diffuser.

* * * * *